US012778245B2

(12) United States Patent
Kinomoto

(10) Patent No.: US 12,778,245 B2
(45) Date of Patent: Nov. 3, 2026

(54) FASTENER ELEMENT, FASTENER STRINGER, AND FASTENER ELEMENT EVALUATION METHOD

(71) Applicant: YKK Corporation, Tokyo (JP)

(72) Inventor: Maho Kinomoto, Toyama-ken (JP)

(73) Assignee: YKK Corporation, Tokyo (JP)

( * ) Notice: Subject to any disclaimer, the term of this patent is extended or adjusted under 35 U.S.C. 154(b) by 123 days.

(21) Appl. No.: 18/849,893

(22) PCT Filed: Mar. 29, 2022

(86) PCT No.: PCT/JP2022/015709
§ 371 (c)(1),
(2) Date: Sep. 23, 2024

(87) PCT Pub. No.: WO2023/188042
PCT Pub. Date: Oct. 5, 2023

(65) Prior Publication Data

US 2025/0318604 A1 Oct. 16, 2025

(51) Int. Cl.
*A44B 19/24* (2006.01)
*A44B 19/06* (2006.01)
*A44B 19/42* (2006.01)

(52) U.S. Cl.
CPC ..... *A44B 19/06* (2013.01); *A44B 19/24* (2013.01); *A44B 19/42* (2013.01); *Y10T 24/2539* (2015.01)

(58) Field of Classification Search
CPC ..... A44B 19/24; A44B 19/02; A44B 19/42; Y10T 24/2539
See application file for complete search history.

(56) References Cited

U.S. PATENT DOCUMENTS 3,150,640 A * 9/1964 Nevitt ..... A61D 3/00 383/41
2009/0298390 A1* 12/2009 Rapacki ..... A61F 2/148 451/36

(Continued)

FOREIGN PATENT DOCUMENTS

CN 113897605 A 1/2022
EP 2394525 A1 12/2011

(Continued)

OTHER PUBLICATIONS

International Preliminary Report on Patentability, PCT Patent Application No. PCT/JP2022/015709, Sep. 24, 2024, 7 pages.

(Continued)

*Primary Examiner* — Jason W San
*Assistant Examiner* — Michael S Lee
(74) *Attorney, Agent, or Firm* — Kilpatrick Townsend & Stockton LLP

(57) ABSTRACT

There is provided a stainless alloy fastener element. The fastener element is a stainless alloy fastener element after being ground by barrel grinding. The fastener element includes a head portion, a pair of leg portions, and an intermediate portion between the head portion and the leg portions. Among black spots of organic matter observed in a backscattered electron (BSE) image of a scanning electron microscope (SEM) image of a side surface of the fastener element, the number of the black spots of the organic matter having a part with a length of 10 μm or more is less than nine in a head portion side surface upper half region or less than nine in an intermediate portion side surface upper half region.

5 Claims, 8 Drawing Sheets

(56) References Cited

U.S. PATENT DOCUMENTS

| | | | | |
|---|---|---|---|---|
| 2017/0119114 | A1* | 5/2017 | Derrig | C22C 27/04 |
| 2022/0002878 | A1 | 1/2022 | Urita et al. | |
| 2023/0076254 | A1* | 3/2023 | Yoshimi | C21D 6/004 |
| 2024/0251917 | A1* | 8/2024 | Maseguchi | A44B 19/02 |
| 2024/0360529 | A1* | 10/2024 | Nishida | C21D 8/0236 |
| 2025/0059615 | A1* | 2/2025 | Nishida | C21D 9/46 |

FOREIGN PATENT DOCUMENTS

| | | | |
|---|---|---|---|
| EP | 3453276 | A1 | 3/2019 |
| JP | 2005-152066 | A | 6/2005 |
| WO | 2010-089854 | A1 | 8/2010 |
| WO | 2017-191688 | A1 | 1/2022 |

OTHER PUBLICATIONS

International Search Report, PCT Patent Application No. PCT/JP2022/015709, Jun. 7, 2022, 5 pages.
Written Opinion, PCT Patent Application No. PCT/JP2022/015709, Jun. 7, 2022, 3 pages.

* cited by examiner

FASTENER ELEMENT, FASTENER STRINGER, AND FASTENER ELEMENT EVALUATION METHOD

TECHNICAL FIELD

The present invention relates to a stainless alloy slide fastener element, a fastener stringer including a fastener element attached to a fastener tape, an evaluation method for a fastener element, and a design method for appropriate barrel grinding conditions based on the evaluation method.

BACKGROUND ART

Grinding a metal fastener element for a slide fastener with a barrel grinding device is a known technique as described in Patent Literature 1 or the like in the related art. Although Patent Literature 1 does not describe a specific description related to barrel grinding of a fastener element, barrel grinding itself is a widely known technique, and materials of grinding media used for barrel grinding, which is already widely known as a general technique, include ceramic media, plastic media, metal media, plant media, and the like. Among these grinding media, ceramic media having relatively high grinding power is widely used.

Here, as a metal material used for a metal slide fastener, there are a copper alloy, a nickel alloy, an aluminum alloy, and the like as described in Patent Literature 1, and the slide fasteners of a copper alloy, a nickel alloy, and an aluminum alloy have already been put into practical use. Among these materials, a copper zinc alloy is a most widely used material since it is an excellent material in terms of work efficiency in being processed into a fine uneven shape such as an element of a slide fastener and maintaining strength necessary for the slide fastener.

In the related art, when a metal element of a copper-zinc alloy slide fastener is subjected to barrel grinding, ceramic media is used as grinding media, and the metal element is ground, with a liquid compound mixed therein, by a rotary barrel grinding machine under wet grinding conditions. Ceramic media is considered to have higher grinding power than other media. Additionally, ceramic media has relatively high durability under long-term use and comes in a wide variety of types. Due to these reasons, using ceramic media is preferred for reducing grinding time and improving work efficiency. Consequently, there seems to be no need to intentionally use plastic media, metal media, and plant media.

In recent years, in addition to a slide fastener using a copper alloy, a nickel alloy, or an aluminum alloy that is put into practical use, there is a growing market demand for a slide fastener using a stainless alloy material. The stainless alloy material is harder than a copper zinc alloy or the like, and is thus difficult to be processed into a shape of a slide fastener element having fine unevenness, and there are concerns in terms of durability of components for processing. Due to these reasons, the stainless alloy material is considered as a material difficult to be put into practical use as a slide fastener product. For these reasons, a copper-zinc alloy slide fastener is mainly used, and a stainless alloy slide fastener is not put into practical use at a general-purpose product level. However, recent years have seen an increasing demand for a stainless alloy slide fastener using a stainless alloy having a more luxurious feel particularly from fields handling high-end products, such as bag and apparel industries.

CITATION LIST

Patent Literature

Patent Literature 1: WO2010-089854A

SUMMARY OF INVENTION

Technical Problem

Even when a stainless alloy is used as a material of a fastener element, a barrel grinding process is effective to improve surface smoothness. In this case, since the stainless alloy is a material harder than the copper zinc alloy, using ceramic media, which is generally superior in terms of reducing grinding time and improving work efficiency, as the grinding media is a primarily considered method for grinding, as in a case of grinding a copper-zinc alloy fastener element in the related art. Actually, an element surface can be ground to a smooth surface of a desired level by appropriately adjusting a type of the ceramic media and conditions of a liquid compound.

However, in this case, although the ground fastener element has a smooth surface of a desired degree, an appearance thereof is slightly darker than an inherent glossy degree of the stainless alloy material. A customer who uses the fastener may prefer a naturally light color of the stainless alloy material. For this reason, blackness of the fastener element after barrel grinding is desired to be further reduced. Accordingly, the developer carried out following analysis to examine a cause of the specific blackness of a stainless alloy fastener element generated after barrel grinding.

FIGS. 5 to 7 illustrate BSE images of scanning electron microscope (SEM) images of an example of a fastener element obtained by rotary barrel grinding a stainless alloy fastener element using ceramic media as grinding media and mixing a liquid compound. FIGS. 8 to 10 are examples of another fastener element subjected to grinding processing similar to that of the fastener element of FIGS. 5 to 7. Here, the BSE images are images obtained by imaging using backscattered electrons. The fastener elements of FIGS. 5 to 10 are fastener elements using a ferritic stainless alloy as a material. A black part in the SEM images (BSE images) is a part to which organic matter adheres. When actually viewed with a naked eye, the black part does not appear distinctly black as in the SEM images (BSE images); instead, an entire periphery thereof looks black and lacks gloss. However, when viewed as a BSE image, the black part appears distinctly black. From this image analysis, it is found that the black part is blackish as a whole due to a fact that a large amount of organic matter originally not present on a surface of the stainless alloy material adheres thereto.

Such a phenomenon does not occur when barrel grinding a copper-zinc alloy fastener element. Accordingly, a reason why a large amount of organic matter adheres only to a stainless alloy fastener element is considered to be that the stainless alloy is easy to be magnetized (or is initially magnetized). That is, it is considered that both of the fastener element and grinding debris are magnetized over time during the barrel grinding, and the grinding debris is easy to adhere to stainless alloy teeth. Accordingly, the organic matter or the like adheres to the surface of the fastener element, and the fastener element is blackened as a whole. The stainless alloy is easy to be magnetized, and this issue is particularly pronounced with a ferritic stainless alloy that is inherently magnetic.

An object of the present invention is to solve the above problem found by the inventor of the present invention, and more specifically, to provide a stainless alloy slide fastener element having a high-gloss appearance inherent to a stainless alloy material by not only simply improving surface smoothness by grinding the slide fastener element but also reducing a degree of blackening due to adhesion of organic matter or the like. Another object of the present invention is to establish a new evaluation method indicating gloss by measuring an amount of organic matter and setting a degree of adhesion as an evaluation target. Still another object of the present invention is to provide a design method for appropriate barrel grinding conditions based on the evaluation method.

Solution to Problem

To achieve the above objects, the present invention provides a stainless alloy fastener element. The fastener element is a stainless alloy fastener element after being ground by barrel grinding. The fastener element includes a head portion including a meshing convex portion on one side, a pair of leg portions on another side, and an intermediate portion between the head portion and the leg portions. When the fastener element is viewed from a side surface thereof, a straight line in an upper-lower direction that passes through an end portion of the fastener element on a side of the head portion in a left-right direction is defined as a straight line L11, a straight line in the upper-lower direction that partitions a boundary between the head portion and the intermediate portion of the fastener element is defined as a straight line L12, a straight line in the upper-lower direction that partitions a boundary between the intermediate portion and the leg portions of the fastener element is defined as a straight line L13, a straight line in the left-right direction that passes through an end portion of the intermediate portion of the fastener element on an upper side in the upper-lower direction is defined as a straight line L21, a straight line in the left-right direction that passes through an end portion of the intermediate portion of the fastener element on a lower side in the upper-lower direction is defined as a straight line L23, and a straight line in the left-right direction that corresponds to an intermediate position between the straight line L21 and the straight line L23 is defined as a straight line L22. When a rectangular region surrounded by the straight line L11, the straight line L12, the straight line L21, and the straight line L22 is defined as a head portion side surface upper half region, and a rectangular region surrounded by the straight line L12, the straight line L13, the straight line L21, and the straight line L22 is defined as an intermediate portion side surface upper half region, among black spots of organic matter observed in a backscattered electron (BSE) image of a scanning electron microscope (SEM) image of a side surface of the fastener element, the number of the black spots of the organic matter having a part with a length of 10 μm or more is less than nine in the head portion side surface upper half region or less than nine in the intermediate portion side surface upper half region.

In the fastener element according to the present invention, the number of the black spots of the organic matter having the part with the length of 10 μm or more among the black spots of the organic matter observed in the backscattered electrode (BSE) image of the scanning electron microscope (SEM) image of the side surface of the fastener element is preferably five or less in the head portion side surface upper half region or five or less in the intermediate portion side surface upper half region.

In the fastener element according to the present invention, the number of the black spots of the organic matter having the part with the length of 10 μm or more among the black spots of the organic matter observed in the backscattered electrode (BSE) image of the scanning electron microscope (SEM) image of the side surface of the fastener element is preferably five or less in total in the head portion side surface upper half region and the intermediate portion side surface upper half region.

An embodiment of the present invention provides a fastener stringer including a fastener element attached to a fastener tape.

Another embodiment of the present invention provides a fastener stringer including a stainless alloy fastener element attached to a fastener tape. The fastener element is a stainless alloy fastener element after being ground by barrel grinding. An average value of brightness L value measured by freely extracting 10 fastener elements of the fastener stringer is 68 or more.

Still another embodiment of the present invention provides a fastener element evaluation method for evaluating a glossy degree of a stainless alloy fastener element. The fastener element is a stainless alloy fastener element after being ground by barrel grinding. The fastener element includes a head portion including a meshing convex portion on one side, a pair of leg portions on another side, and an intermediate portion between the head portion and the leg portions. The glossy degree of the fastener element is evaluated by the number of black spots of organic matter having a length of a prescribed value or more in the head portion or the intermediate portion among the black spots of the organic matter observed in a backscattered electron (BSE) image of a scanning electron microscope (SEM) image of a side surface of the fastener element.

An embodiment to which the fastener element evaluation method is applied provides a design method for a barrel grinding condition, in which an appropriate barrel grinding condition is obtained by the evaluation method for evaluating the glossy degree of the stainless alloy fastener element.

Advantageous Effects of Invention

According to the present invention, it is possible for a stainless alloy slide fastener element to have a high-gloss appearance and a natural color of a stainless alloy material by not only simply improving surface smoothness by barrel grinding but also reducing a degree of blackening due to adhesion of organic matter or the like.

DESCRIPTION OF EMBODIMENTS

Hereinafter, a preferred embodiment of the present invention will be described in detail with reference to the drawings. The present invention is not limited to the embodiment described below, and it should be assumed that combinations and recombinations of features of the embodiments are also within the scope of the present invention, and that it is also within the scope of the present invention to replace a part of the embodiments with one having substantially the same configuration.

Figure 1:
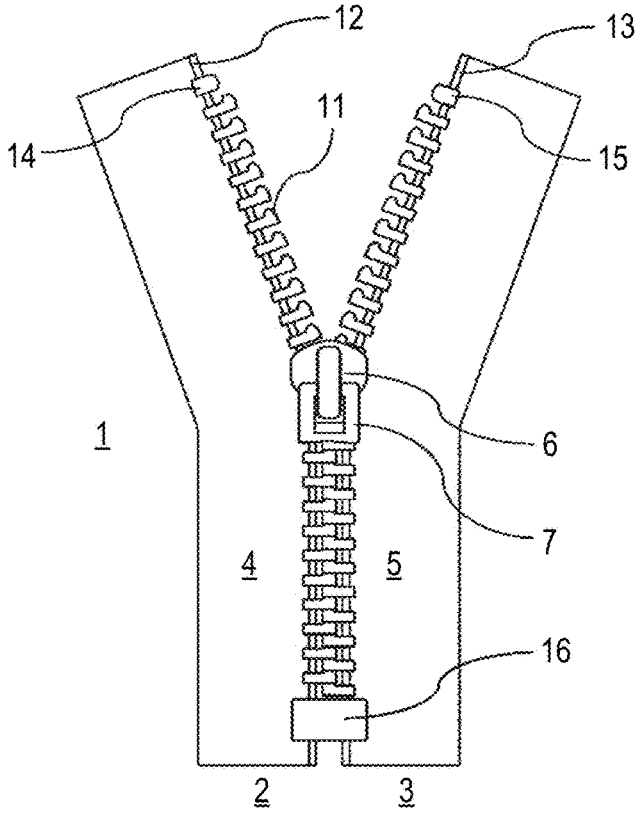
FIG. 1 is a plan view illustrating a slide fastener according to an embodiment of the present invention.

FIG. 1 is a plan view illustrating a slide fastener 1 according to the embodiment of the present invention. The slide fastener 1 includes left and right fastener stringers 2 and 3, and the left and right fastener stringers 2 and 3 respectively include fastener tapes 4 and 5 and fastener elements 11 attached to the fastener tapes 4 and 5. The fastener elements 11 are attached to side edge portions 12 and 13 of the fastener tapes 4 and 5. When a slider 6 moves forward and backward along rows of the fastener elements 11, the left and right fastener stringers 2 and 3 are opened and closed. The slider 6 is provided with a pull tab 7 for operating the slider 6. The fastener tapes 4 and 5 are respectively provided with upper stoppers 14 and 15 adjacent to uppermost ends of the fastener elements 11 so that the slider 6 does not come off from upper end sides of the fastener elements 11. The fastener tapes 4 and 5 are further provided with lower stoppers 16 on lower end sides of the rows of the fastener elements 11 so that the slider 6 does not come off from lower end sides of the fastener elements 11. The slide fastener in FIG. 1 is a finished product of a stop type slide fastener using the lower stoppers 16. Alternatively, a slide fastener using the fastener elements 11 of the present invention is not limited to a finished product of a stop type slide fastener. For example, the fastener elements 11 of the present invention are also used in a finished product of an open type slide fastener including, instead of the lower stoppers 16, openers that can separate the left and right fastener stringers 2 and 3 into left and right.

In description of the present application, an upward direction is defined as a direction in which the slider 6 is moved to close the fastener stringers 2 and 3, and a downward direction is defined as a direction in which the slider 6 is moved to open the fastener stringers 2 and 3. A left-right direction is defined as a direction orthogonal to an upper-lower direction in a plane defined by spreading the fastener tapes 4 and 5 in a planar shape in a state in which the fastener stringers 2 and 3 are closed. That is, in a state in which the slide fastener 1 illustrated in the plan view of FIG. 1 is closed, the direction orthogonal to the upper-lower direction is the left-right direction. A front-back direction is defined as a direction orthogonal to the upper-lower direction and the left-right direction defined above. That is, in the state of FIG. 1, a direction orthogonal to a paper surface of FIG. 1 is the front-back direction, and FIG. 1 is a view in which the fastener stringers 2 and 3 are viewed from a front side toward a back side.

The fastener tapes 4 and 5 are flexible fabrics such as woven fabrics or knitted fabrics, and are long in the upper-lower direction and short in the left-right direction. The fastener tapes 4 and 5 have a constant thickness in the front-back direction, and the fastener elements 11 are attached to the side edge portions 12 and 13 on corresponding one sides of the fastener tapes 4 and 5 in the left-right direction. The side edge portions 12 and 13 preferably have a thickness larger than the constant thickness of bodies of the tapes, and these parts having a larger thickness are referred to as core cords. By forming the side edge portions 12 and 13 as core cords having an appropriate thickness, the fastener elements 11 can be more firmly attached.

Figure 2:
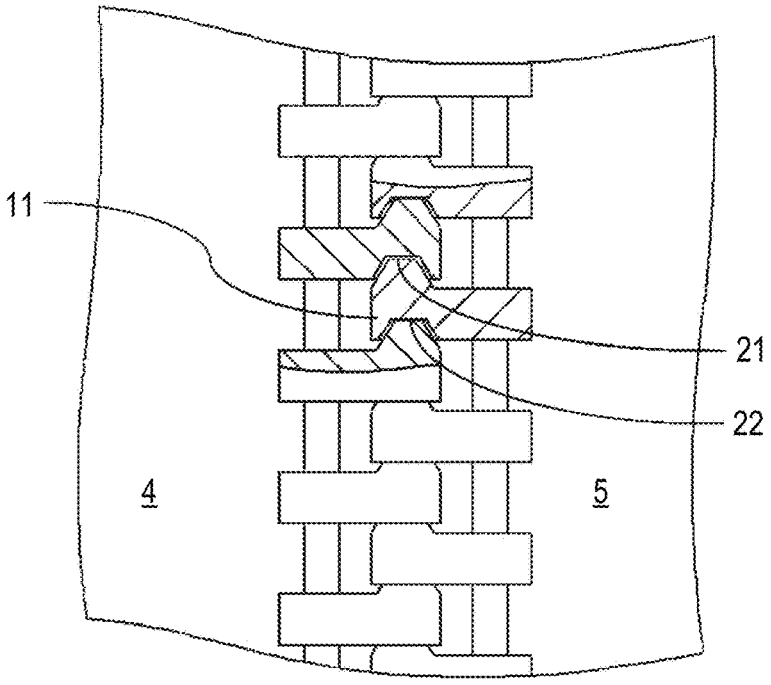
FIG. 2 is an enlarged view of a portion of element rows of the slide fastener of FIG. 1, in which a hatched area is illustrated in a partial sectional view.

FIG. 2 is an enlarged view of a portion of element rows of the slide fastener 1 in FIG. 1, and a hatched area is illustrated in a partial sectional view for easy understanding of a specific shape of the fastener elements 11. The sectional part illustrates a state in which a meshing convex portion 21 of the fastener element 11 enters a meshing concave portion 22 of the adjacent fastener element 11 and the fastener elements 11 continuously mesh with each other. In the present application, a fastener stringer is not a term that means only the fastener stringer 2 or the fastener stringer 3 used in a finished product of the stop type slide fastener 1 illustrated in FIG. 1, but a term that means an elongated member in a state in which the fastener elements 11 are simply continuously attached to a fastener tape as illustrated in FIG. 2 (in other words, a component constituted by only the fastener tape and the fastener elements before being finished into the finished product of the slide fastener illustrated in FIG. 1). The upper-lower direction, the left-right direction, and the front-back direction defined above are also used as definitions of directions when the fastener elements 11 are viewed alone in a state in which the fastener stringers 2 and 3 are closed as illustrated in FIG. 2. That is, the fastener elements 11 in FIG. 2 are illustrated in a plan view on a plane defined by two directions including the left-right direction and the upper-lower direction, and also a partial sectional view illustrating a part thereof in section. The fastener elements 11 of FIG. 2 are also illustrated as viewed from a front surface side. In the present specification, front surfaces of the fastener elements 11 when the fastener elements 11 are viewed from the front surface side or a back surface side as illustrated in FIG. 2 may be referred to as side surfaces of the fastener elements 11, the left-right direction of the fastener elements 11 may be referred to as a length direction of the fastener elements 11, and the upper-lower direction of the fastener elements 11 may be referred to as a thickness direction of the fastener elements 11.

Figure 3:
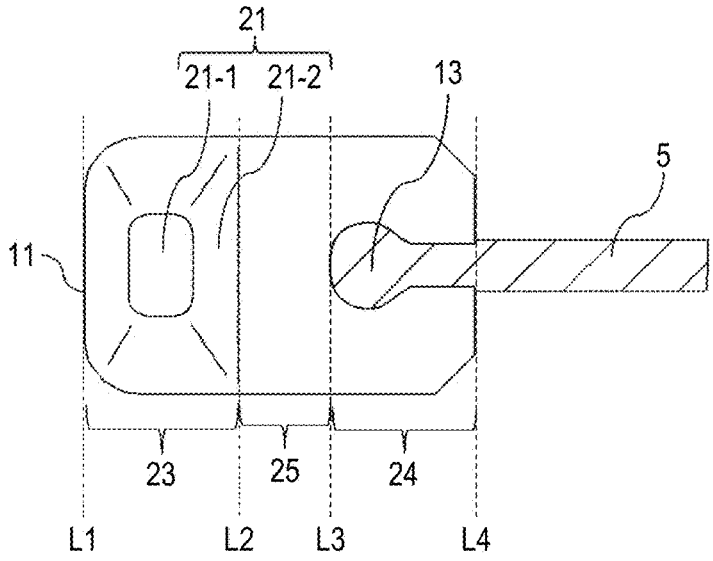
FIG. 3 illustrates a state when one fastener element illustrated in FIG. 2 is viewed from an upper side of the slide fastener, in which a part that is a fastener tape is illustrated in section.

FIG. 3 illustrates a state when one of the fastener elements 11 illustrated in FIG. 2 is viewed from an upper side of the slide fastener 1, in which a part that is the fastener tape 5 is illustrated in section. The fastener element 11 includes a head portion 23 including the meshing convex portion 21 on one side, and a pair of leg portions 24 extending on a side opposite to the head portion 23. The meshing convex portion 21 includes a top surface portion 21-1 that is a surface including an apex of the convex portion, and convex portion inclined surfaces 21-2 that surround a periphery of the top surface portion 21-1. For convenience of description, the fastener element 11 is divided into three parts including the head portion 23, the leg portions 24, and an intermediate portion 25. In FIG. 3, a dotted line L1 is a straight line in the front-back direction that passes through an end portion (end portion on a head portion side, left end portion) of the fastener element 11 on one side in the left-right direction, and a dotted line L4 is a straight line in the front-back direction that passes through an end portion (end portion on a leg portion side, right end portion) of the fastener element 11 on another side in the left-right direction. A dotted line L2 is a straight line in the front-back direction that passes through an end portion (right end portion) of the meshing convex portion 21 of the fastener element 11 on the leg portion side. A dotted line L3 is a straight line in the front-back direction that passes through an end portion (left end portion) of the side edge portion 13 of the fastener tape 5 on the head portion side. In other words, the dotted line L3 is a straight line in the front-back direction that passes through a branch point at which the pair of leg portions are branched. A part partitioned between a plane in the upper-lower direction that includes the dotted line L1 and a plane in the upper-lower direction that includes the dotted line L2 is the head portion 23 of the fastener element 11, a part partitioned between a plane in the upper-lower direction that includes the dotted line L2 and a plane in the upper-lower direction that includes the dotted line L3 is the intermediate portion 25 of the fastener element 11, and a part partitioned between a plane in the upper-lower direction that includes the dotted line L3 and a plane in the upper-lower direction that includes the dotted line L4 is the leg portions 24 of the fastener element 11. The leg portions 24 include a pair of members, and the pair of leg portions 24 crimp the side edge portion 13 of the fastener tape 5, so that the fastener element 11 is fixed to the fastener tape 5. In FIG. 3, a line segment represents an end portion since most lines of an outer shape of the fastener element 11 are simplified as straight lines. However, in a case of an actual photograph, the outer shape of the fastener element 11 may be a curved line. In this case, the "end portion" in the above description refers to a position of a point that is an end portion of the curved line partitioning the outer shape of the fastener element 11.

Figure 4:
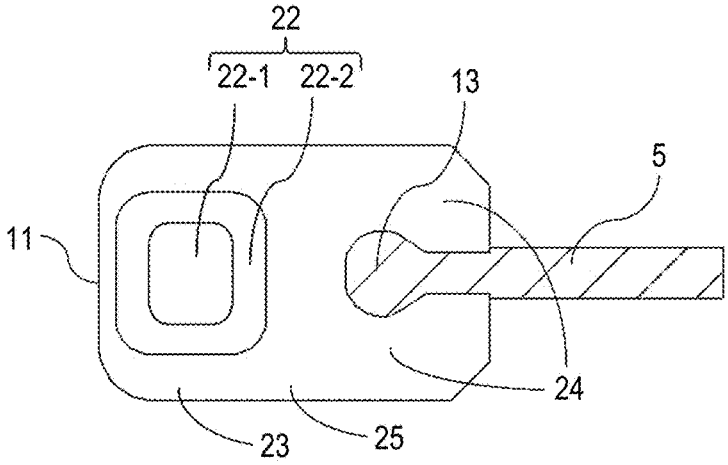
FIG. 4 illustrates a state when the fastener element illustrated in FIG. 2 is viewed from a lower side of the slide fastener, in which the part that is the fastener tape is illustrated in section.

FIG. 4 illustrates a state when the fastener element illustrated in FIG. 2 is viewed from a lower side of the slide fastener, in which the part that is the fastener tape is illustrated in section. The fastener element 11 includes the meshing concave portion 22 on one side and the pair of leg portions 24 extending on another side. The meshing concave portion 22 is formed in a position opposite to the meshing convex portion in the upper-lower direction, and includes a bottom surface portion 22-1 that is a bottom surface of the concave portion and concave portion inclined surfaces 22-2 that surround a periphery of the bottom surface portion 22-1. In FIG. 4, the dotted lines L1 to L4 illustrated in FIG. 3 are omitted, and definitions of the head portion 23, the leg portions 24, and the intermediate portion 25 are as described in FIG. 3.

The fastener element 11 of the slide fastener 1 according to the present invention is made of a stainless alloy material. As the stainless alloy material, SUS 430 that is a ferritic stainless alloy material is exemplified, and the stainless alloy material is not limited thereto. Specifically, a composition of one example is stainless steel containing a certain amount or more of chromium in iron, and the stainless steel is a ferritic stainless steel containing 16.0 to 18.0% of chromium. An example of the stainless alloy material other than the ferritic stainless alloy material includes an austenitic stainless steel containing 8.0 to 10.50% of nickel and 18.0 to 20.0% of chromium.

The fastener element 11 of the slide fastener 1 according to the present invention is manufactured by cutting and pressing a metal material. Then, the fastener element 11 according to the present invention is ground by a barrel grinding device at a time point after a stage in which the fastener element 11 is formed into a shape including the meshing convex portion 21 and the meshing concave portion 22 by pressing and before a stage in which the fastener element 11 is attached to the fastener tape 5. In the grinding process, a generally used rotary barrel grinding device is used as the barrel grinding device.

Regarding the grinding process, a case of barrel grinding a copper-zinc alloy slide fastener element in the related art, which serves as a comparison of the embodiment of the present invention, will be described. This is referred to as a comparative example in the present specification.

A manufacturing method of the comparative example will be described. The fastener element 11 that is made of a ferritic stainless alloy material containing 16.0 to 18.0% of chromium as a raw material and has a shape including the meshing convex portion 21 and the meshing concave portion 22 by pressing is first subjected to a degreasing process in a stage before a grinding process. In the degreasing process, the fastener element 11 is put into a barrel and stirred together with ceramic grinding media, water, a degreasing agent, and the like, and is then rinsed with water. After the fastener element 11 is rinsed with water, water, a liquid compound, and the like are added to the barrel for the subsequent grinding process and then stirred to perform the grinding process. The liquid compound can be appropriately selected and used from commercially available products such as a metal surface treatment agent Gildaon series manufactured by Chuo Kagaku Co., Ltd., and an abrasive compound for barrel manufactured by Sintokogio, Ltd. After the grinding process is completed, the fastener element 11 is rinsed with water, then subjected to a pickling treatment, and then dried to be in a state before crimping and fixing a fastener tape.

Figure 5:
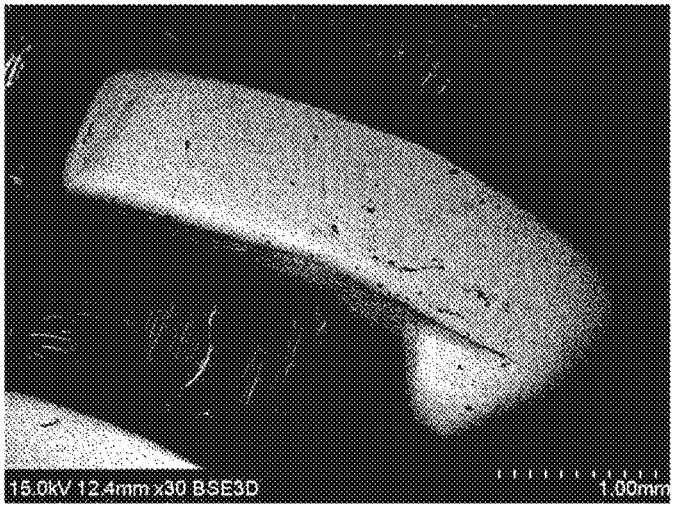
FIG. 5 illustrates a SEM image of a fastener element of Comparative Example 1 (observation magnification being 30 times, observation field of view being 3 mm×4.2 mm).
Figure 6:
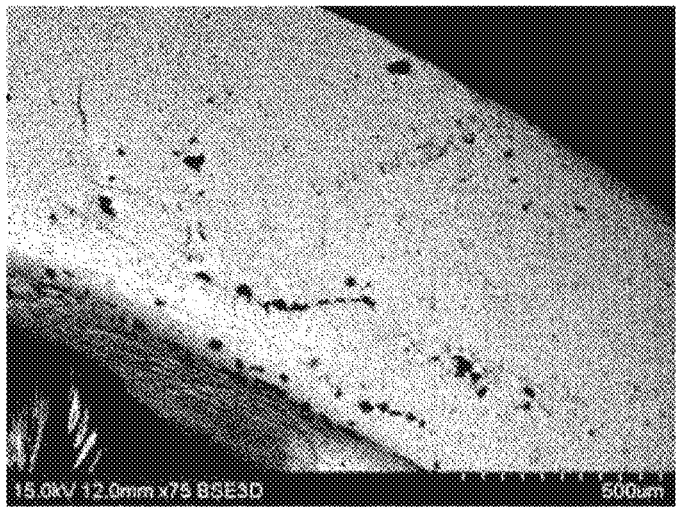
FIG. 6 illustrates an enlarged SEM image of a vicinity of an intermediate portion of the fastener element in FIG. 5 (observation magnification being 75 times, observation field of view being 1.2 mm×1.7 mm).
Figure 7:
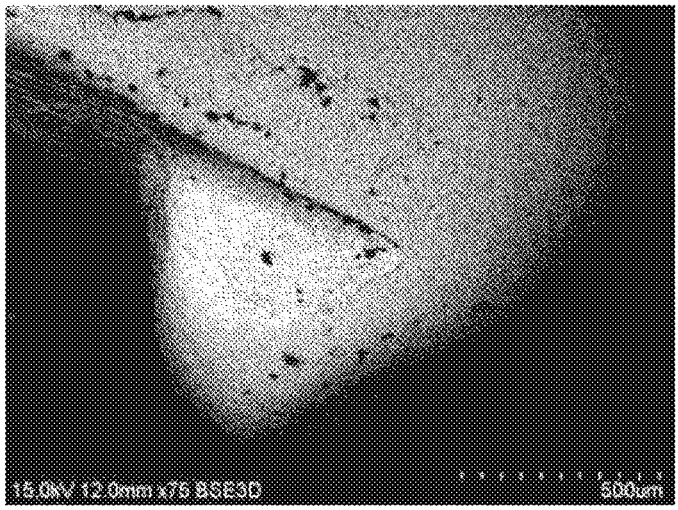
FIG. 7 illustrates an enlarged SEM image of a vicinity of a head portion of the fastener element in FIG. 5 (observation magnification being 75 times, observation field of view being 1.2 mm×1.7 mm).
Figure 8:
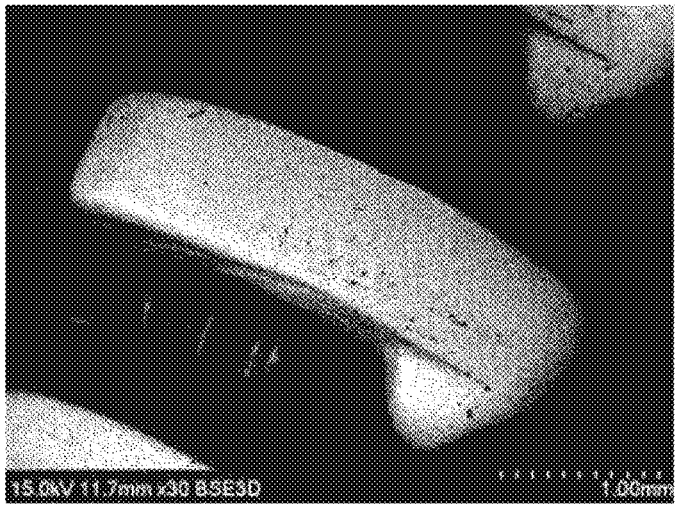
FIG. 8 illustrates a SEM image of a fastener element of Comparative Example 2 (observation magnification being 30 times, observation field of view being 3 mm×4.2 mm).
Figure 9:
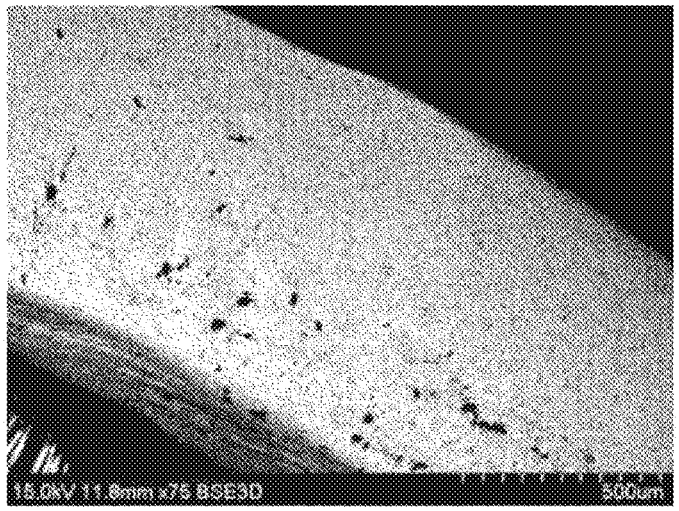
FIG. 9 illustrates an enlarged SEM image of a vicinity of an intermediate portion of the fastener element in FIG. 8 (observation magnification being 75 times, observation field of view being 1.2 mm×1.7 mm).
Figure 10:
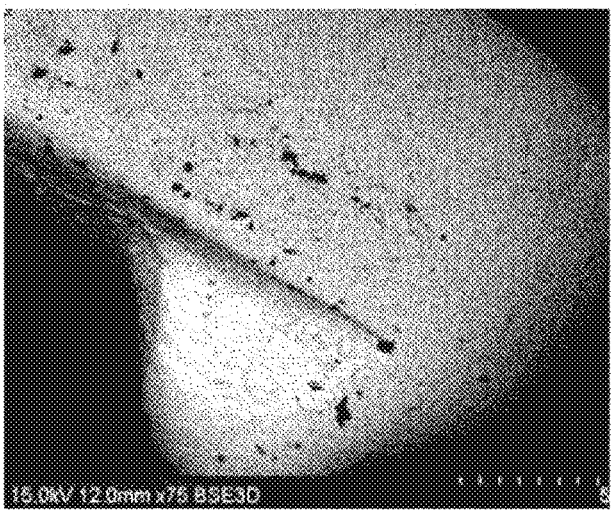
FIG. 10 illustrates an enlarged SEM image of a vicinity of a head portion of the fastener element in FIG. 8 (observation magnification being 75 times, observation field of view being 1.2 mm×1.5 mm).

FIGS. 5 to 10 illustrate SEM images (BSE images) of fastener elements ground in the comparative example. FIGS. 5 to 7 illustrate BSE images of scanning electron microscope (SEM) images of an example, and are referred to as Comparative Example 1 in the present specification. FIGS. 8 to 10 illustrate another example, and are referred to as Comparative Example 2 in the present specification. FIG. 5 illustrates an SEM image of a side surface of an element of Comparative Example 1, FIG. 6 illustrates an enlarged SEM image of a vicinity of an intermediate portion of the image of the fastener element in FIG. 5, and FIG. 7 is an enlarged SEM image of a vicinity of a head portion of the image of the fastener element in FIG. 5. Similarly, FIG. 8 is an SEM image of a side surface of an element of Comparative Example 2, FIG. 9 is an enlarged SEM image of a vicinity of an intermediate portion of the image of the fastener element in FIG. 8, and FIG. 10 is an enlarged SEM image of a vicinity of a head portion of the image of the fastener element in FIG. 9. A black part in the SEM images (BSE images) is a part to which organic matter adheres. When actually viewed with a naked eye, the black part does not appear distinctly black as in the SEM images (BSE images); instead, a periphery thereof looks black and lacks gloss. However, when viewed as a BSE image, the black part appears distinctly black. From this image analysis, it is found that the black part is blackish as a whole due to a fact that a large amount of organic matter originally not present on a surface of the stainless alloy material adheres thereto.

Such a phenomenon does not occur when barrel grinding a copper-zinc alloy fastener element. A reason why a large amount of organic matter adheres only to a stainless alloy fastener element is considered to be that the stainless alloy is easy to be magnetized (or is initially magnetized). That is, the fastener element and grinding debris are magnetized over time during the barrel grinding, and the grinding debris is easy to be attracted to the fastener element of the stainless alloy. At this time, it is considered that organic matter of the grinding debris adheres to the fastener element, and the surface of the fastener element is blackened. The stainless alloy is easy to be magnetized, and this issue is particularly pronounced with a ferritic stainless alloy that is inherently magnetic.

Based on such a technical assumption, to prevent adhesion of the organic matter, it is considered effective to take two measures, that is, to reduce generation of grinding debris that is a cause and to remove the generated grinding debris before the grinding debris adheres to the fastener element 11. Grinding media is made by sintering abrasives and a binder component connecting thereof. The grinding media according to the present invention is made of plastic. At the same time, a compound having particularly excellent dirt adsorption properties is used, whereby the adhesion of the generated grinding debris to the fastener element is minimized. Plastic media is generally widely used ranging from grinding a hard metal to smooth finishing a surface of a soft metal. When grinding the stainless alloy fastener element 11 of the present invention, a desired appearance is obtained by using plastic media excellent in both grinding and smooth finishing of a surface. The compound has a function of adsorbing grinding debris in liquid to minimize the adhesion of the grinding debris to the fastener element 11 while maintaining an efficient grinding state. Examples of a powder compound for adsorbing the grinding debris include a cleaning compound (eco-friend powder compound) manufactured by Kimura Soap Co., Ltd. and a cleaning compound (climax compound) manufactured by Toho Koki Co., Ltd. Alternatively, the present invention is not limited thereto, and a powder compound having a function of adsorbing grinding debris can be used. Further, the stainless steel fastener element 11 of the present invention can be manufactured without adding a pickling process after the grinding process as performed in the comparative example. The pickling process has an environmental burden due to usage of an acidic chemical, and a fact that sufficient gloss can be obtained even without the pickling process can be said to be excellent in terms of environmental protection.

Figure 11:
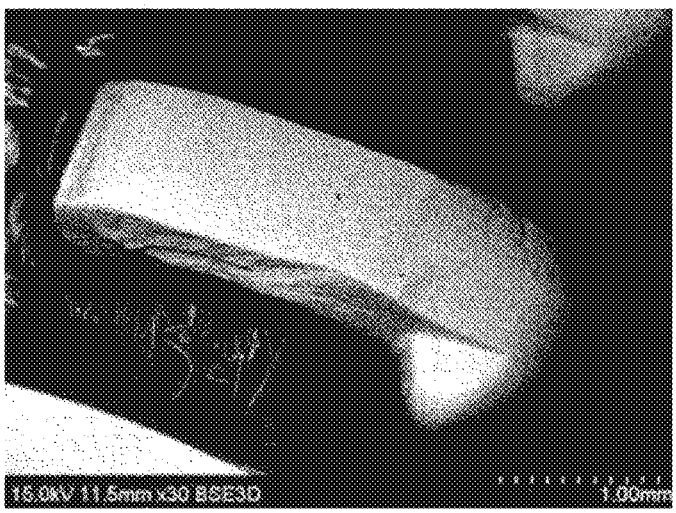
FIG. 11 illustrates a SEM image of a fastener element of Example 1 (observation magnification being 30 times, observation field of view being 3 mm×4.2 mm).
Figure 12:
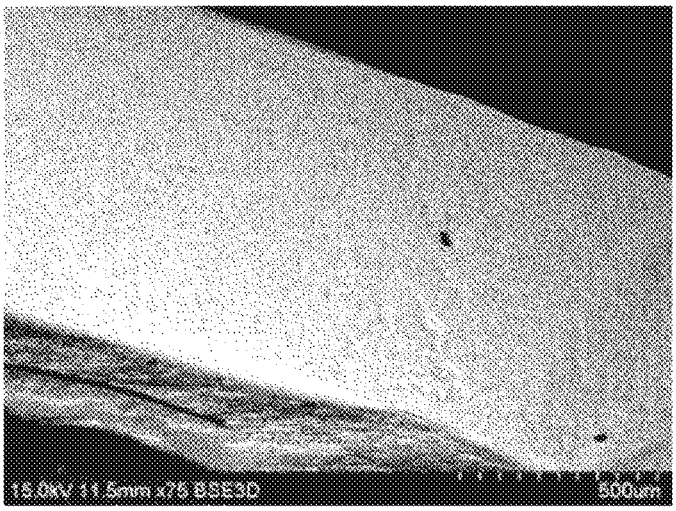
FIG. 12 illustrates an enlarged SEM image of a vicinity of an intermediate portion of the fastener element in FIG. 11 (observation magnification being 75 times, observation field of view being 1.2 mm×1.7 mm).
Figure 13:
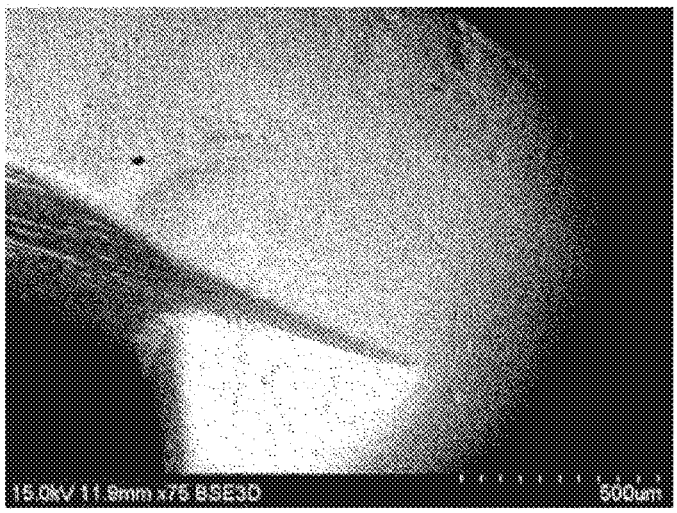
FIG. 13 illustrates an enlarged SEM image of a vicinity of a head portion of the fastener element in FIG. 11 (observation magnification being 75 times, observation field of view being 1.2 mm×1.7 mm).
Figure 14:
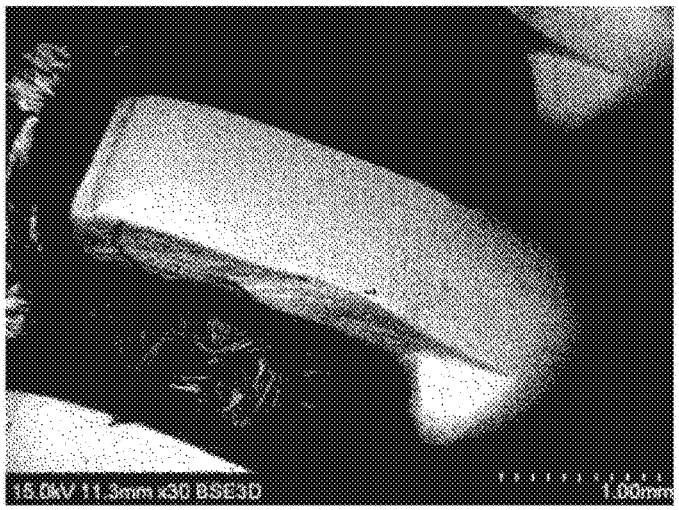
FIG. 14 illustrates a SEM image of a fastener element of Example 2 (observation magnification being 30 times, observation field of view being 3 mm×4.2 mm).
Figure 15:
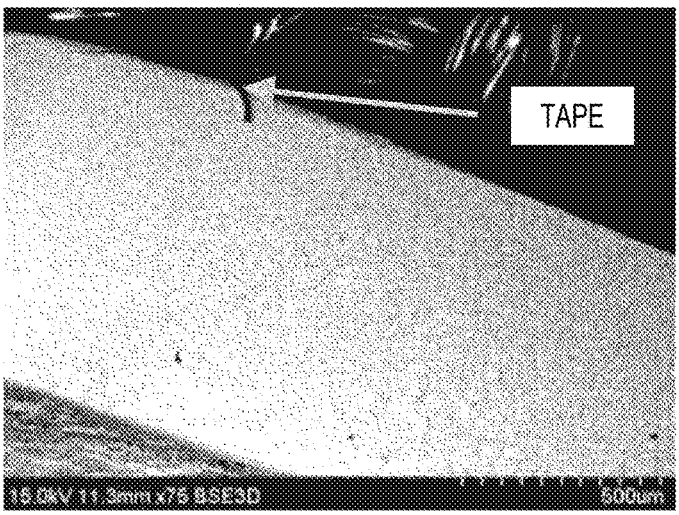
FIG. 15 illustrates an enlarged SEM image of a vicinity of an intermediate portion of the fastener element in FIG. 14 (observation magnification being 75 times, observation field of view being 1.2 mm×1.7 mm).
Figure 16:
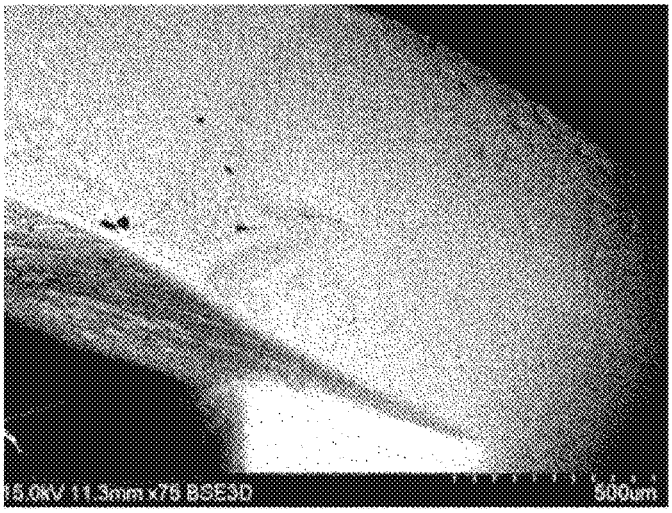
FIG. 16 illustrates an enlarged SEM image of a vicinity of a head portion of the fastener element in FIG. 14 (observation magnification being 75 times, observation field of view being 1.2 mm×1.7 mm).

FIGS. 11 to 13 illustrate SEM images (BSE images) of the fastener element 11 according to the present invention, and are referred to as Example 1 in the present specification. FIGS. 14 to 16 are SEM images (BSE images) of another example of the fastener element 11 according to the present invention, and are referred to as Example 2 in the present specification. The fastener elements 11 of Examples 1 and 2 are also fastener elements 11 using a ferritic stainless alloy as a material. FIG. 11 illustrates an SEM image of a side surface of the element of Example 1, FIG. 12 illustrates an enlarged SEM image of a vicinity of an intermediate portion of the fastener element 11 of Example 1, and FIG. 13 illustrates an enlarged SEM image of a vicinity of a head portion of the fastener element 11 of Example 1. Similarly, FIG. 14 illustrates an SEM image of a side surface of the fastener element 11 of Example 2, FIG. 15 illustrates an enlarged SEM image of a vicinity of an intermediate portion of the fastener element 11 of Example 2, and FIG. 16 illustrates an enlarged SEM image of a vicinity of a head portion of the image of the fastener element 11 of Example 2. There is a black part indicated by "tape" and an arrow in FIG. 15, which is for describing that the black part is not adhesion of organic matter due to grinding debris since a part of a thread of a fastener tape is caught on the fastener element 11 and captured in the image.

Figure 17:
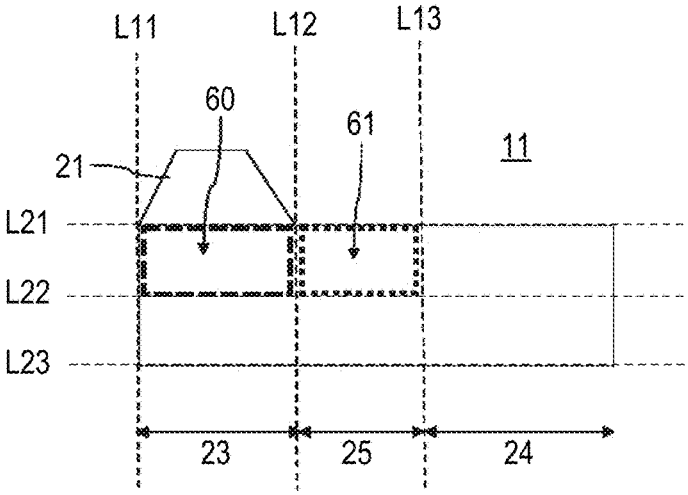
FIG. 17 illustrates definitions of a "head portion side surface upper half region 60" and an "intermediate portion side surface upper half region 61".
Figure 22:
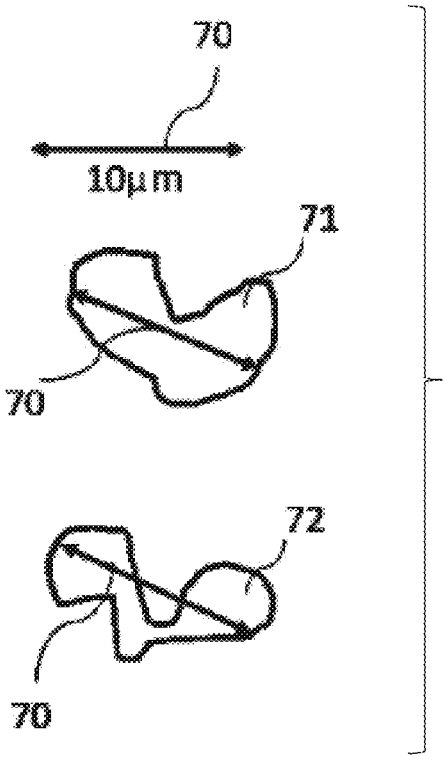
FIG. 22 illustrates a measurement method for "a black spot of organic matter having a part with a length of 10 μm or more".

When the SEM images of Examples 1 and 2 are compared with the SEM images of Comparative Examples 1 and 2 illustrated in FIGS. 5 to 10, it can be seen that black parts in the SEM images of Examples 1 and 2 are significantly reduced. To objectively and numerically express the number of the black parts, regions including a "head portion side surface upper half region 60" and an "intermediate portion side surface upper half region 61" in FIG. 17 are defined. In these regions, comparison is performed regarding the number of observed black spots of organic matter having a part with a length of 10 μm or more. Here, the "length" is a length that can be measured when a black part of a black spot observed in an SEM image is measured as an unbroken line segment in any direction. For reference, FIG. 22 illustrates an example of a method for measuring whether the "length" is 10 μm or more. In FIG. 22, an arrow 70 is a line segment having a length of 10 μm. A black frame line indicated by a reference numeral 71 is an outer edge line of a black spot example 71 of the organic matter. A black frame line indicated by a reference numeral 72 is an outer edge line of a black spot example 72 of the organic matter. In the black spot example 71 of the organic matter, the line segment 70 can be measured inside the outer edge line without breaking. On the other hand, in a case of the black spot example 72 of the organic matter, the line segment 70 cannot be measured inside the outer edge line and is broken in the middle. For this reason, the black spot example 72 of the organic matter is not a "black spot of the organic matter having a part with a length of 10 μm or more" defined in the present specification.

FIG. 17 illustrates definitions of the "head portion side surface upper half region 60" and the "intermediate portion side surface upper half region 61". In FIG. 17, a rectangular region surrounded by dotted lines L11, L12, L21, and L22 is defined as the "head portion side surface upper half region 60". A rectangular region surrounded by dotted lines L12, L13, L21, and L22 in FIG. 17 is defined as the "intermediate portion side surface upper half region 61".

Here, the dotted line L11 is a straight line in the upper-lower direction that passes through one end portion (left end portion) of the fastener element 11 in the left-right direction when the fastener element is viewed from a side surface (when viewed from the front surface side). The dotted line L12 is a straight line in the upper-lower direction that passes through an end portion (end portion of the meshing convex portion 21 on a right side) of the meshing convex portion 21 on a leg portion side when the fastener element is viewed from the side surface. In other words, the dotted lines L11 and L12 are straight lines whose positions in the left-right direction coincide with positions of the dotted lines L1 and L2 that are lines partitioning the head portion 23 of the fastener element 11 defined by the line view of FIG. 3. The dotted line L13 is a straight line whose position in the left-right direction coincides with a position of the dotted line L3 that is a line partitioning a boundary between the intermediate portion 25 and the leg portions 24 of the fastener element 11 defined by the line view of FIG. 3. The dotted line L21 is a straight line in the left-right direction that passes through an end portion of the intermediate portion 25 on an upper side in the upper-lower direction when the fastener element is viewed from the side surface. A dotted line L23 is a straight line in the left-right direction that passes through an end portion of the intermediate portion 25 on a lower side in the upper-lower direction when the fastener element is viewed from the side surface. The dotted line L22 is a straight line corresponding to an intermediate position between the dotted lines L21 and L23 when the fastener element is viewed from the side surface (in other words, a straight line in the left-right direction in an intermediate position of a thickness of the intermediate portion 25 in the upper-lower direction). In FIG. 17, a line segment represents an end portion since lines of an outer shape of the fastener element are simplified as straight lines. However, in a case of an actual photograph, the outer shape of the fastener element 11 may be a curved line. In this case, the "end portion" in the above description refers to a position of a point that is an end portion of the curved line partitioning the outer shape of the fastener element 11. In FIG. 17, rectangular outer peripheral lines of the "head portion side surface upper half region 60" and the "intermediate portion side surface upper half region 61" are highlighted by thick dotted lines.

Next, an example of counting the number of observed black spots of organic matter having a length of 10 μm or more in the "head portion side surface upper half region 60" and the "intermediate portion side surface upper half region 61" will be described.

Figure 18:
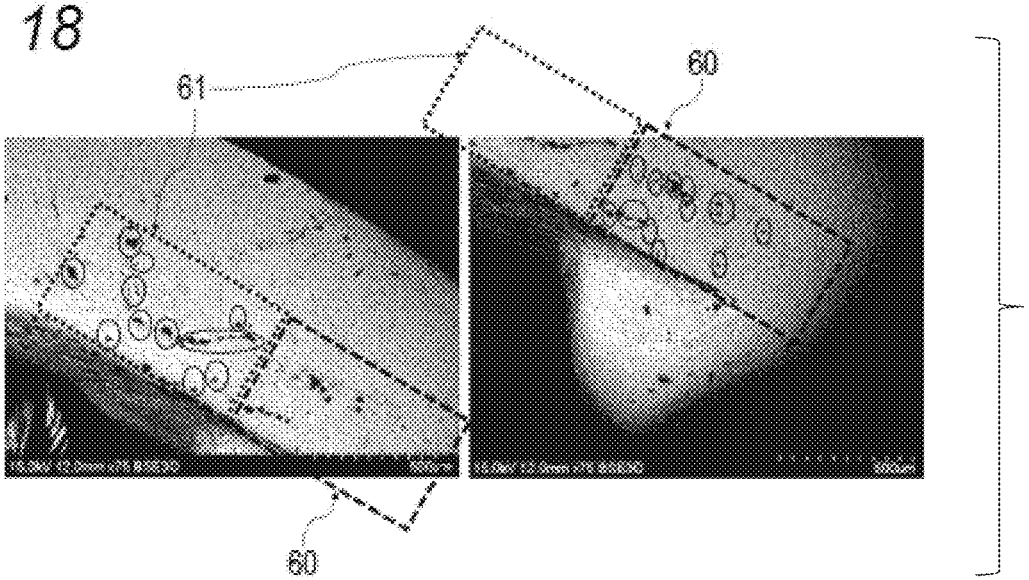
FIG. 18 illustrates main points for counting the number of black spots of organic matter in the "head portion side surface upper half region 60" and the "intermediate portion side surface upper half region 61" in Comparative Example 1.

FIG. 18 illustrates main points for counting the number of black spots of the organic matter in the "head portion side surface upper half region 60" and the "intermediate portion side surface upper half region 61" in Comparative Example 1. For easy understanding, two SEM images are arranged side by side, and an image on a left side of FIG. 18 is FIG. 6 and an image on a right side is FIG. 7. The SEM images have an observation magnification of 75 times and an observation field of view of 1.2 mm×1.7 mm, and a line dividing 500 μm into 10 scales is displayed on lower right of each image. In FIG. 18, the "head portion side surface upper half region 60" and the "intermediate portion side surface upper half region 61" correspond to parts of substantially rectangular dotted lines (the "head portion side surface upper half region 60" and the "intermediate portion side surface upper half region 61" are displayed to be slightly smaller than actual so as not to be difficult to see in a black part around the fastener element 11). In each part of the "head portion side surface upper half region 60" and the "intermediate portion side surface upper half region 61", a circle is added to a part that can be clearly identified as a black spot of the organic matter having a part with a length of 10 μm or more.

In the SEM image on the left side of FIG. 18, at least 11 circles can be added to the "intermediate portion side surface upper half region 61". In the specification of the present application, it is not practical to illustrate a clear image having high resolution since there is a restriction on conditions for creating drawings that can be disclosed in a patent publication or the like. For this reason, at least 11 herein means that the number of easily counted circles is at least 11 for sake of illustration in the above-mentioned range. It is needless to say that a comparison should be performed between images having higher image quality when an actually existing fastener element is compared with the present invention. Since the drawings of the present application are black and white images, a shadow such as a processing mark and a scratch on the surface of the fastener element 11 generated during processing of the fastener element 11 may be displayed in black. A black part of a shadow of a processing mark and a scratch can be easily identified by visually observing an image having high image quality. In the description of the present application, it is sufficiently noted that a black part of a shadow of such a processing mark and a scratch is not marked by a circle. Among the circles in FIG. 18, plural black spots in one circle may overlap with each other and appear to be a continuous straight line black part. Even when the plural black spots are counted as one black spot instead of being divided into two or more, it is also emphasized that at least 11 circles can be added to the "intermediate portion side surface upper half region 61" of the SEM image on the left side in FIG. 18. On the other hand, from the SEM image on the right side of FIG. 18, at least 12 circles can be added to the "head portion side surface upper half region 60". The at least 12 should be interpreted as the same meaning as that described in the counting in the "intermediate portion side surface upper half region 61".

Figure 19:
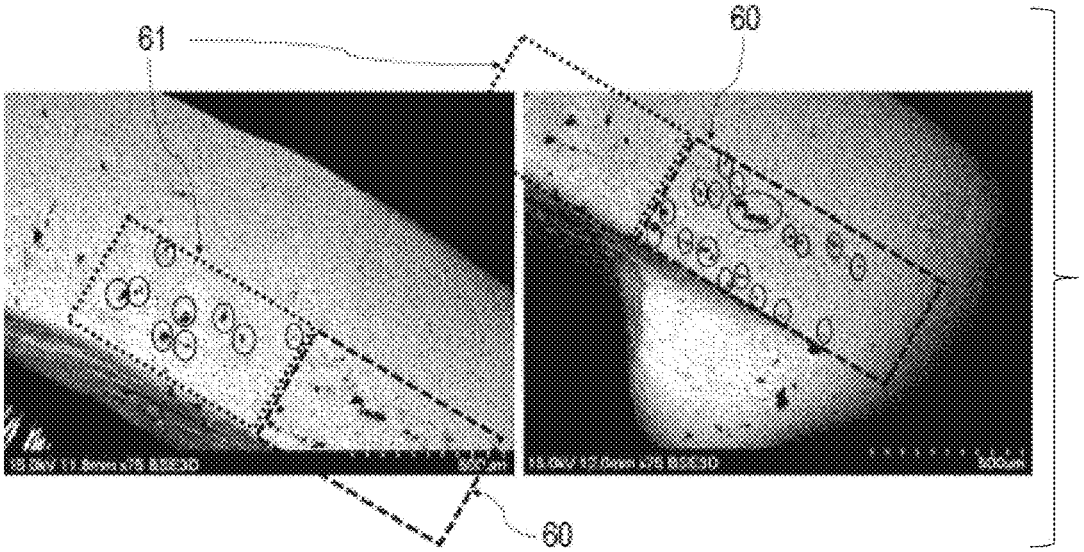
FIG. 19 illustrates main points for counting the number of black spots of organic matter in the "head portion side surface upper half region 60" and the "intermediate portion side surface upper half region 61" in Comparative Example 2.

FIG. 19 illustrates main points for counting the number of black spots of the organic matter in the "head portion side surface upper half region 60" and the "intermediate portion side surface upper half region 61" in Comparative Example 2. An image on a left side of FIG. 19 is FIG. 9, and an image on a right side is FIG. 10. Main points for adding and counting circles are the same as those described in FIG. 18.

In the SEM image on the left side of FIG. 19, at least nine circles can be added to the "intermediate portion side surface upper half region 61". On the other hand, from the SEM image on the right side of FIG. 19, at least 18 circles can be added to the "head portion side surface upper half region 60".

Subsequently, the SEM images in Examples 1 and 2 are similarly analyzed.

Figure 20:
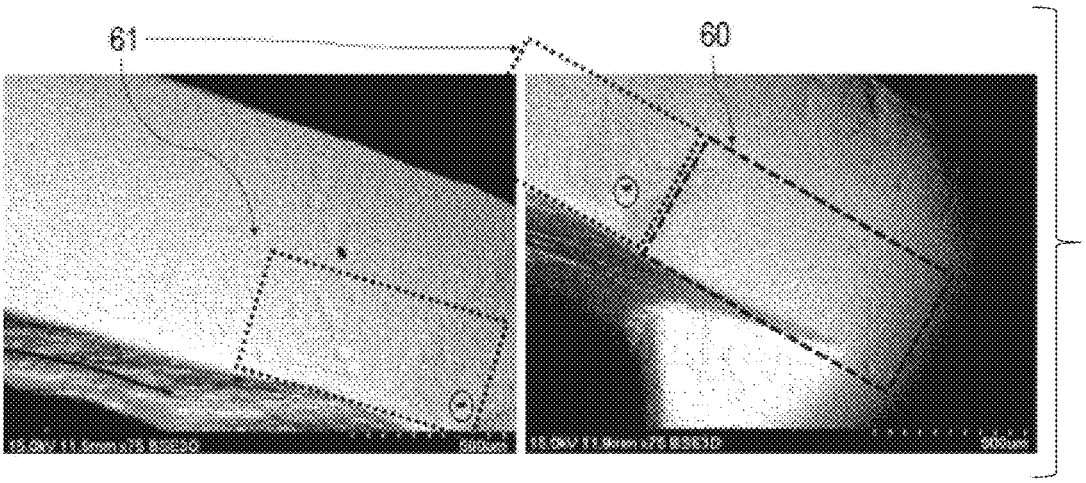
FIG. 20 illustrates main points for counting the number of black spots of organic matter in the "head portion side surface upper half region 60" and the "intermediate portion side surface upper half region 61" in Example 1.

FIG. 20 illustrates main points for counting the number of black spots of organic matter in the "head portion side surface upper half region 60" and the "intermediate portion side surface upper half region 61" in Example 1. An image on a left side of FIG. 20 is FIG. 12, and an image on a right side is FIG. 13. Main points for adding and counting circles are the same as those described in FIG. 18.

In the SEM image on the left side of FIG. 20, one circle can be added to the "intermediate portion side surface upper half region 61". On the other hand, in the SEM image on the right side of FIG. 20, no black spot to be applied with a circle was observed in the "head portion side surface upper half region 60". Although the SEM image on the right side of FIG. 20 has slightly black parts, these black parts are displayed as shadows of processing marks and scratches on the surface of the fastener element 11 (confirmed in a drawing having higher image quality that cannot be attached to the present application due to the restriction on conditions for creating drawings that can be disclosed in a patent publication or the like).

Figure 21:
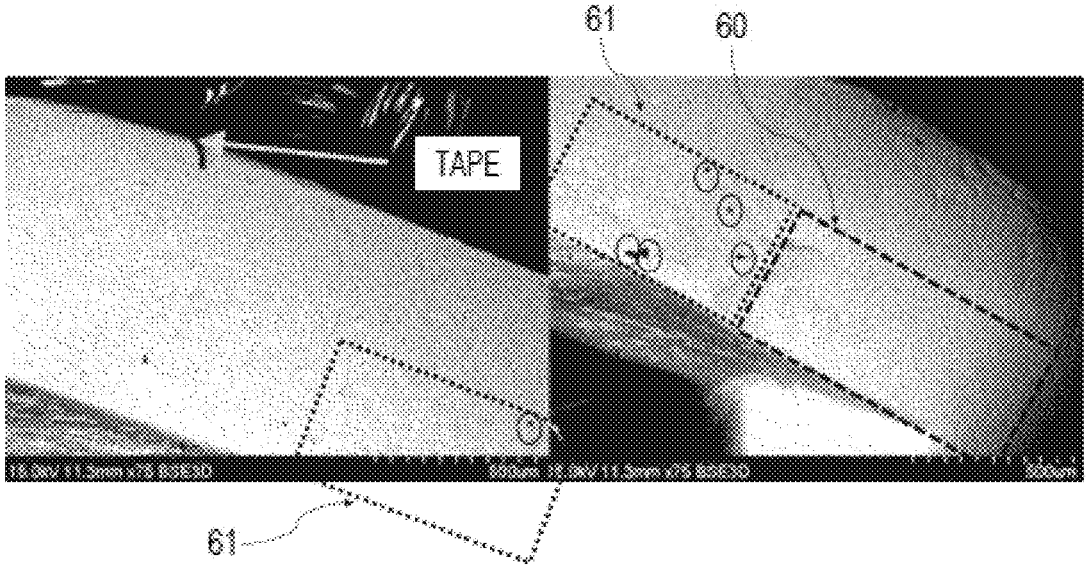
FIG. 21 illustrates main points for counting the number of black spots of organic matter in the "head portion side surface upper half region 60" and the "intermediate portion side surface upper half region 61" in Example 2.

FIG. 21 illustrates main points for counting the number of black spots of organic matter in the "head portion side surface upper half region 60" and the "intermediate portion side surface upper half region 61" in Example 2. An image on a left side of FIG. 21 is FIG. 15, and an image on a right side is FIG. 16. Main points for adding and counting circles are the same as those described in FIG. 18.

When the SEM image on the right side of FIG. 21 is checked with reference to the SEM image on the left side of FIG. 21, five circles can be added to the "intermediate portion side surface upper half region 61" in Example 2. In the SEM image on the right side of FIG. 21, no black spot to be applied with a circle was observed in the "head portion side surface upper half region 60".

This shows that, when the fastener element 11 of an example of the present invention is compared with a fastener element of a comparative example, a degree of light is a difference in a degree of whiteness that can be seen even by eyes. To describe this with a more objective indicator, color difference was measured. Here, the color difference measurement, according to JIS standard JIS Z8781-4, involves measuring brightness L* value, redness a* value, and blueness b* value as basic quantities. In a test of the present application, the color difference measurement was carried out with RTC-21 ILOREAL Real True Color XYZ Camera manufactured by Ikegami Tsushinki Co., Ltd.

As a result, the color difference of a sample of the example was measured 10 times, and an average value of measurement results of the brightness L value was 70.971. Ten measurement values of the brightness L value of the sample of the example were 70.8946, 70.8657, 71.1024, 71.2827, 70.9779, 70.8181, 71.0721, 70.5552, 71.3319, and 70.812. The 10 measurements were carried out by extracting 10 different elements from one fastener chain and measuring side surfaces thereof. Measurement values of the redness a* value and the blueness b* value are not directly related to gloss comparison of the present invention, and thus description thereof is omitted in the present specification. On the other hand, the color difference of a sample of the comparative example was measured 10 times, and an average value of measurement results of the brightness L value was 67.360. Ten measurement values of the brightness L value of the sample of the comparative example were 68.3598, 68.5746, 67.5335, 67.4546, 67.9951, 66.8156, 67.2344, 65.2125, 67.1513, and 67.2675. The 10 measurements were carried out by extracting 10 different elements from one fastener chain and measuring side surfaces thereof. The number of measurements is not limited to 10 times, and an approximately comparable average value can be obtained when the number of measurements is 10 times or more.

In this manner, the inventor of the present invention found that it is possible to provide the stainless alloy fastener element 11 having high brightness by reducing a degree of adhesion of grinding debris to the surface of the fastener element 11 when grinding the stainless alloy fastener element 11. The average value of the brightness L value of the comparative example is less than 68, and most of the 10 individual measurement results are lower than 68, while the average value of the brightness L value of the example of the present invention is more than 68. Accordingly, it is clear that the stainless alloy fastener element 11 having an average value of brightness of 68 or more can be obtained by reducing the number of black spots of the organic matter as in the present invention. According to the above measurement results, it can be understood that the average value of the brightness L value of 70 or more would serve as a numerical indication for the stainless alloy fastener element 11 having more preferable gloss.

An indication for reducing the degree of adhesion of the grinding debris to the surface of the fastener element 11 during grinding can be obtained from the analysis results of the SEM images of the comparative example and the example described above with reference to FIGS. 18 to 21. The analysis results of the SEM images illustrated in FIGS. 18 to 21 described above are summarized as follows.

Example 1: the number of observed black spots in the head portion side surface upper half region 60 is zero, the number of observed black spots in the intermediate portion side surface upper half region 61 is one, and a total number is one.

Example 2: the number of observed black spots in the head portion side surface upper half region 60 is zero, the number of observed black spots in the intermediate portion side surface upper half region 61 is five, and a total number is five Comparative Example 1: the number of observed black spots in the head portion side surface upper half region 60 is 12, the number of observed black spots in the intermediate portion side surface upper half region 61 is 11, and a total number is 23

Comparative Example 2: the number of observed black spots in the head portion side surface upper half region 60 is 18, the number of observed black spots in the intermediate portion side surface upper half region 61 is nine, and a total number is 27

From these results, it can be understood that the object of the present invention cannot be achieved when the number of observed black spots in the head portion side surface upper half region 60 or the intermediate portion side surface upper half region 61 is nine or more as in the comparative example. That is, it can be understood that a fact that the number of observed black spots in the head portion side surface upper half region 60 or the intermediate portion side surface upper half region 61 is less than nine is one indicator for forming the slide fastener element 11 of the present invention.

When this indicator is limited to a more preferable numerical range, as is seen from the SEM image of Example 2, even when the number of observed black spots is substantially five in a range of a size of the intermediate portion side surface upper half region 61 of the element, gloss of an appearance of the element is not remarkably inferior, and it can be seen that the adhesion number of the black spots can be sufficiently reduced as a whole even when viewing FIG. 14 illustrating the SEM image of the entire element of Example 2. From this, it can be understood that a fact that the number of observed black spots in the head portion side surface upper half region 60 or the intermediate portion side surface upper half region 61 is five or less is also one indicator for forming the slide fastener element 11 of the present invention.

Further, it can be understood that a total number of observed black spots of five or less in the head portion side surface upper half region 60 and the intermediate portion side surface upper half region 61 as in the example is most preferable. Accordingly, it can be understood that the total number of observed black spots of five or less in the head portion side surface upper half region 60 and the intermediate portion side surface upper half region 61 is also one condition indication for the embodiment of the present invention.

As described above with reference to FIGS. 1 to 4, the stainless alloy fastener element 11 obtained as described above continuously crimp to be fixed to the side edge portion 13 of the fastener tape 5 at regular intervals, thereby forming the fastener stringers 2 and 3 according to the present invention. Then, the fastener stringers 2 and 3 are cut to an appropriate length and appropriately equipped with a stopper, an opener, a slider, and the like and finished, whereby a finished product of a slide fastener is obtained.

As described above, it is clear from the disclosure of the present invention that the stainless alloy slide fastener element 11 is blackened by adhesion of organic matter to the slide fastener element 11 during grinding, and it is clear that by reducing the degree of adhesion of the organic matter under conditions disclosed in the present invention, it is possible to provide the slide fastener element 11 having a high-gloss appearance and a natural color of a stainless alloy material.

The embodiment of the present invention describes a so-called single-sided element including the meshing convex portion 21 on one surface side of the head portion 23 of the fastener element 11 and the meshing concave portion 22 on another surface side. Alternatively, a shape of the fastener element is not limited thereto, and the technical concept of the present invention can also be applied to, for example, a so-called double-sided element including a meshing convex portion and a meshing concave portion on each of one surface side and the other surface side.

Various conditions for the image analysis such as the magnification of the SEM image in the present invention are not limited to the comparison between the present invention and an actual product under conditions described in the embodiment of the present invention, and any method can be used as long as the comparison with the present invention can be performed.

The present invention is not limited only to the embodiments disclosed above, and it is also possible to appropriately use techniques recognized by those skilled in the art as techniques substantially the same as or techniques having the same effects as the technical matters described in the embodiments of the present invention, and these techniques can also be used as alternative or addition.

REFERENCE SIGNS LIST

1 slide fastener
2, 3 fastener stringer
4, 5 fastener tape
6 slider
7 pull tab
11 fastener element
12, 13 side edge portion
14, 15 upper stopper
16 lower stopper
21 meshing convex portion
21-1 top surface portion of meshing convex portion 21
21-2 convex portion inclined surface of meshing convex portion 21
22 meshing concave portion
22-1 bottom surface portion of meshing concave portion 22
22-2 concave portion inclined surface of meshing concave portion 22
23 head portion of fastener element 11
24 leg portion of fastener element 11
25 intermediate portion of fastener element 11
60 head portion side surface upper half region
61 intermediate portion side surface upper half region

The invention claimed is:

1. A stainless steel alloy fastener element, wherein the fastener element is a stainless steel alloy fastener element after being ground by barrel grinding, the fastener element includes a head portion including a meshing convex portion on one side, a pair of leg portions on another side, and an intermediate portion between the head portion and the leg portions, when the fastener element is viewed from a side surface thereof, a straight line in an upper-lower direction that passes through an end portion of the fastener element on a side of the head portion in a left-right direction is defined as a straight line L11, a straight line in the upper-lower direction that partitions a boundary between the head portion and the intermediate portion of the fastener element is defined as a straight line L12, a straight line in the upper-lower direction that partitions a boundary between the intermediate portion and the leg portions of the fastener element is defined as a straight line L13, a straight line in the left-right direction that passes through an end portion of the intermediate portion of the fastener element on an upper side in the upper-lower direction is defined as a straight line L21, a straight line in the left-right direction that passes through an end portion of the intermediate portion of the fastener element on a lower side in the upper-lower direction is defined as a straight line L23, a straight line in the left-right direction that corresponds to an intermediate position between the straight line L21 and the straight line L23 is defined as a straight line L22, when a rectangular region surrounded by the straight line L11, the straight line L12, the straight line L21, and the straight line L22 is defined as a head portion side surface upper half region, and a rectangular region surrounded by the straight line L12, the straight line L13, the straight line L21, and the straight line L22 is defined as an intermediate portion side surface upper half region, among black spots of organic matter observed in a back-scattered electron (BSE) image of a scanning electron microscope (SEM) image of a side surface of the fastener element, a number of the black spots of the organic matter having a part with a length of 10 μm or more is less than nine in the head portion side surface upper half region or less than nine in the intermediate portion side surface upper half region.

2. The fastener element according to claim 1, wherein the number of the black spots of the organic matter having the part with the length of 10 μm or more among the black spots of the organic matter observed in a back-scattered electrode (BSE) image of the scanning electron microscope (SEM) image of the side surface of the fastener element according to claim 1 is five or less in the head portion side surface upper half region or five or less in the intermediate portion side surface upper half region.

3. The fastener element according to claim 1, wherein the number of the black spots of the organic matter having the part with the length of 10 μm or more among the black spots of the organic matter observed in a back-scattered electrode (BSE) image of the scanning electron microscope (SEM) image of the side surface of the fastener element according to claim 1 is five or less in total in the head portion side surface upper half region and the intermediate portion side surface upper half region.

4. A fastener stringer comprising the fastener element according to claim 1 attached to a fastener tape.

5. A fastener stringer comprising a stainless steel alloy fastener element attached to a fastener tape, wherein the fastener element is a stainless steel alloy fastener element after being ground by barrel grinding, and an average value of brightness L value measured by freely extracting ten fastener elements elements of the fastener stringer is 68 or more.

* * * * *